343-754 SR
1/4/77 OR 4,001,835

United States Patent [19]

Dover et al.

[11] 4,001,835

[45] Jan. 4, 1977

[54] SCANNING ANTENNA WITH EXTENDED OFF BROADSIDE SCANNING CAPABILITY

[75] Inventors: R. Thomas Dover; Christian O. Hemmi, both of Dallas, Tex.

[73] Assignee: Texas Instruments Incorporated, Dallas, Tex.

[22] Filed: May 12, 1975

[21] Appl. No.: 576,919

[52] U.S. Cl. ..... 343/754; 343/761

[51] Int. Cl.[2] .....H01Q 3/18; H01Q/19/06

[58] Field of Search ..... 343/753, 343/754, 755, 761, 839

[56] References Cited

UNITED STATES PATENTS

| | | | |
|---|---|---|---|
| 3,408,654 | 10/1968 | Walker | 343/754 |
| 3,761,935 | 9/1973 | Silbiger | 343/754 |
| 3,833,909 | 9/1974 | Schaufelberger | 343/754 |

*Primary Examiner*—Eli Lieberman
*Attorney, Agent, or Firm*—Harold Levine; Rene' E. Grossman; Alva H. Bandy

[57] ABSTRACT

An improved Lewis scanner comprising a focal lens having two best focus angles positioned with its axis at an angle other than perpendicular to the antenna aperture. The antenna aperture is maintained vertical with respect to the earth's surface to provide a planar beam at 0° elevation. The focal lens axis is oriented at an angle of typically one-half the maximum elevation scan angle. The angle of the microwave reflector between the parallel plates of the Lewis scanner is changed from the conventional 45° by one-half the angle between the focal lens axis and the 0° elevation angle. An asymmetric feed lens improves the beam shape over the entire scan range.

8 Claims, 4 Drawing Figures

SCANNING ANTENNA WITH EXTENDED OFF BROADSIDE SCANNING CAPABILITY

This invention relates to microwave scanning antennas and, more particularly, to parallel plate waveguide scanning antennas.

A Lewis scanner is a well-known microwave antenna which radiates in a fan shaped pattern. This scanner is typically used to provide location information to aircraft by scanning the beam in a direction perpendicular to its broad beam width. The useful embodiments of this type of antenna comprise a pair of concentric metal cylinders assembled to produce a cylindrical parallel plate waveguide. A flat parallel plate waveguide intersects the cylindrical waveguide and provides a radiating aperture. A helical reflector positioned at 45° to the cylindrical axis is positioned within the cylindrical portion of the waveguide to allow microwave energy to be fed into one end of the cylindrical waveguide. The resulting scanner allows a microwave energy feed horn to rotate in a circular path while radiation occurs as if the feed horn was following a linear path. A microwave lens is positioned between the plates of the waveguide near the radiating aperture. The microwave feed horn is located approximately in the focal path of this lens so that the lens forms a narrow beam in one dimension. Thus, if the radiating slot is vertical, the lens forms a narrow beam in elevation but does not narrow the normally broad azimuth coverage.

Several problems have been recognized as limiting the usefulness of the basic Lewis scanner. The radiation pattern is actually conical with the radiating aperture being the axis of the cone. The total scanning range is limited for any given antenna and is centered about the aperture normal. Therefore, for vertical scanning, a choice must be made between using only half the available scan capability of the antenna or having the conical beams referenced to an inclined axis. In other words, if a vertical aperture is used to provide a flat beam at the horizon, the beam can be scanned above the horizon by only one-half the scanning range.

The feed horn is also located at the best focal point of the lens only when radiation is perpendicular to the antenna aperture. As the horn moves away from the focal point to scan the beam away from the aperture normal, the elevational pattern is degraded by higher side lobes and distorted beam shape. This is one of the factors which limits the maximum useful scan range of any given antenna.

In addition, the best elevational beam shape is achieved by moving the feed horn in a focal path which is curved with respect to distance from the lens. The problem was recognized in U.S. Pat. No. 3,761,935 "Wide Angle Microwave Scanning Antenna Array with Distortion Correction Means" issued to R. J. Silbiger et al. on Sept. 25, 1973. This patent discloses the use of a symmetrical feed lens to add a variable phase shift to the input energy. The feed lens causes the feed horn distance from the focal lens to appear to change as the horn rotates. The feed lens also changes the actual angle of incidence of energy upon the reflector. At horn positions which generate maximum elevational radiation, this angle change causes a substantial amoung of energy to travel from the feed horn to the focal lens without hitting the reflector. The result is a weakened main beam and a large side lobe radiated toward the ground to cause unwanted reflections.

Accordingly, an object of the present invention is to provide an improved Lewis scanner.

Another object of the present invention is to provide a scanning antenna having a flat pattern at 0° elevation.

Another object of the present invention is to provide a scanning antenna which scans above 0° elevation by its full scanning angle range.

Another object of the present invention is to provide a scanning antenna having improved elevational focusing over the full scan range.

A scanning antenna according to the present invention comprises a parallel plate waveguide microwave radiator having a vertical radiating end and a microwave lens having one or more best focus angles positioned between the plates of the parallel plate waveguide with its axis positioned at an angle between the aperture normal and the maximum scan angle above the aperture normal. Scanning microwave feed means are positioned at an input end of the parallel plate waveguide substantially in the focal path of the focal lens.

Other objects, features, and advantages of this invention will become better understood by reference to the following detailed description when read in conjunction with the accompanying drawings wherein.

Figure 1:
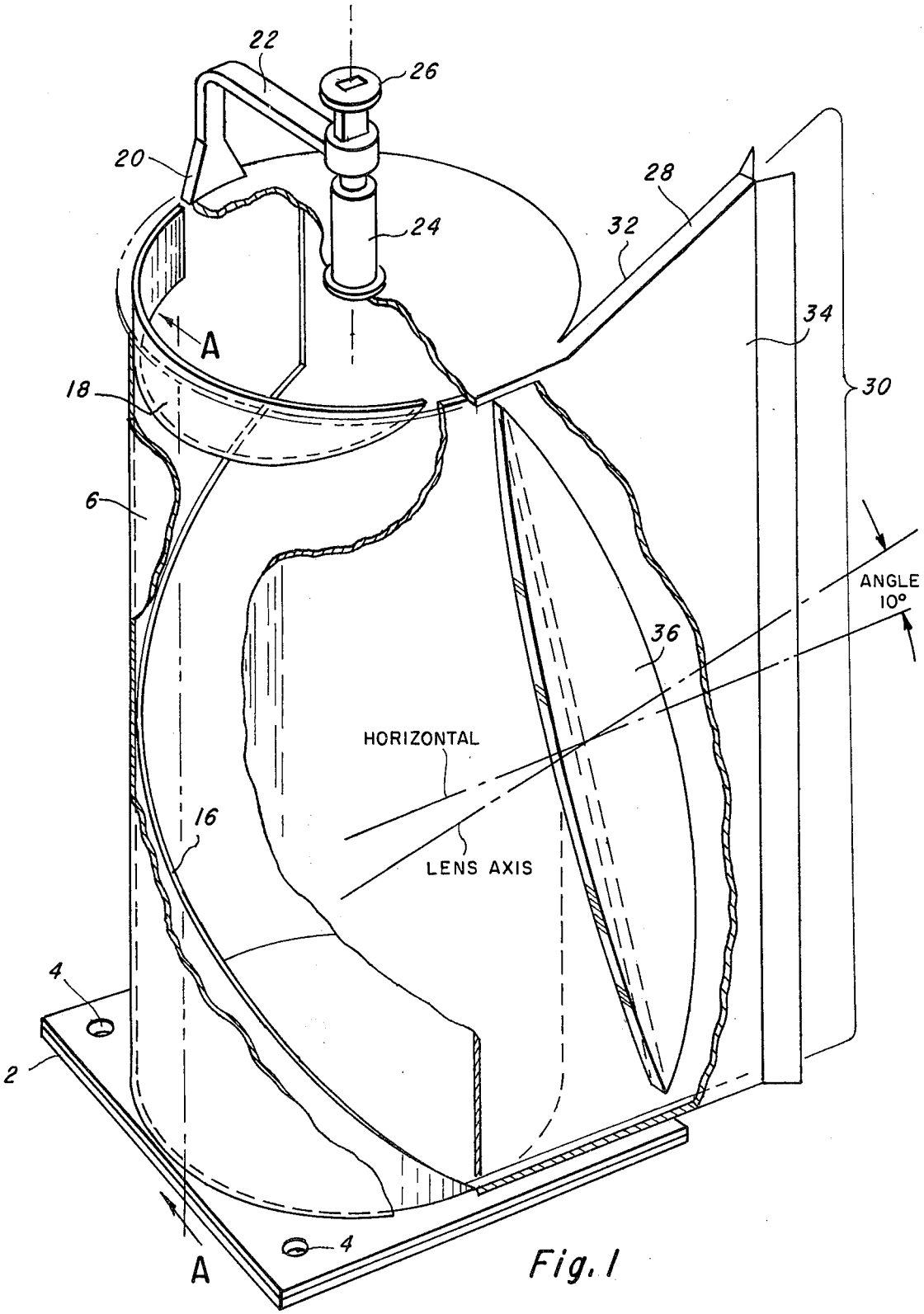
FIG. 1 is a perspective view of a scanning antenna according to the present invention.

FIG. 1 is a partially broken away perspective view of a microwave scanning antenna according to the present invention. A square aluminum plate 2 supports the antenna assembly and has holes 4 for bolting the antenna to a suitable support structure. Mounted on plate 2 is a cylindrical waveguide 6. In the preferred embodiment, the cylindrical waveguide 6 comprises a five layer structure. This structure (FIG. 2) includes inner and outer mechanically supporting layers 8 and 10. Layers 8 and 10 have conductive aluminum foil 14 bonded to their opposing surfaces. A 0.187 inch thick layer of polypropylene foam 12 fills the space between the aluminum foil 14 lined supporting layers 8 and 10. The foam layer 12 has a dielectric constant of approximately 1.05 and is, therefore, electrically essentially the same as an air layer. The foam 12 provides an exact spacing of the aluminum foil layers 14 which form the conducting surfaces of the parallel plate waveguide 6. The foam layer 12 additionally prevents the introduction of moisture or other foreign material between the plates of the waveguide 6.

An aluminum foil helical refector 16 is formed within the foam layer 12. In this preferred embodiment, reflector 16 is positioned at an angle of 50° with respect to the longitudinal axis of the cylindrical waveguide 6.

A polyethylene feed lens 18 is positioned between the walls 14 of the cylindrical parallel plate waveguide 6 at its input end. The lens 18 is machined from a 0.187 inch thick polyethylene sheet in a shape that is described below and shown in FIG. 4. A portion of the polypropylene foam is removed from the waveguide 6 at its input end to allow the feed lens 18 to be placed between the waveguide plates. It is not necessary to cut the polypropylene foam to exactly match the contour of feed lens 18 since the dielectric constant of the foam is approximately the same as that of air which fills the spaces left from an imperfect fit.

Figure 2:
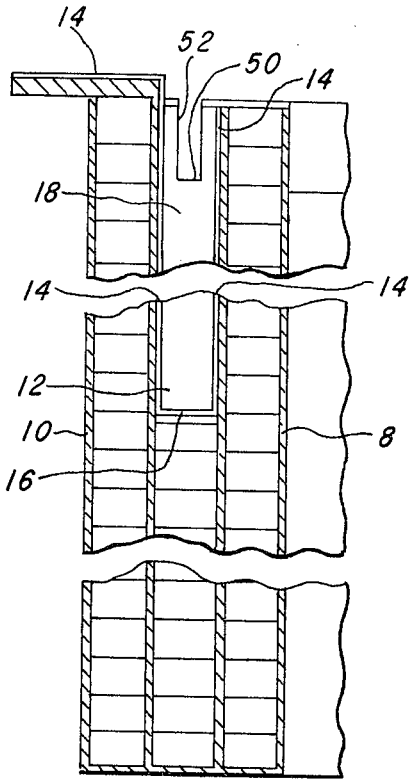
FIG. 2 is a sectional view of the wall of a scanning antenna taken along section line A—A of FIG. 1.

FIG. 2 also shows a cross-sectional view of the top edge of the feed lens 18. An impedance matching transformer is generated in the edge of this lens 18 by cutting a groove 52 therein. The groove 52 is 0.235 inches deep and has a width of 0.083 inch. The bottom edge 50 of the groove 52 is located on the lens contour lines as defined in FIG. 4 below. This groove arrangement helps to match the characteristic transmission line impedance between the area filled by the lens which has a dielectric constant 2.3 and the air or foam filled areas. For other embodiments this impedance matching groove 52 has other widths and depths according to lens dielectric constant and operating frequency.

A feed element such as, for example, a horn 20 is positioned to couple energy into the cylindrical waveguide 6 through its circular top edge. Feed horn 20 is mechanically coupled by waveguide 22 to a motor 24 which drives feed horn 20 in a circular path in alignment with the top surface of waveguide 6. Waveguide 22 receives microwave energy from an external source through a rotating microwave coupling 26 and couples this energy to feed horn 20.

A flat parallel plate waveguide 28 intersects the cylindrical waveguide 6 and provides a radiating aperture 30. Flat wave guide 28 is formed from two flat aluminum plates 32 and 34 spaced 0.187 inches apart. Plates 32 and 34 are flared at one edge to form the radiating aperture 30. A flat focal lens 36 machined from 0.187 inch thick polyethylene sheet is positioned between the plates of flat waveguide 28. The exact shape of focal lens 36 is completely described below. In the preferred embodiment focal lens 36 is positioned so that its axis is 10° above the horizon when the aperture 30 is vertical. The lens axis is a straight line bisecting the two contours of the lens at right angles and about which the lens is symmetric. This angle is one-half of the maximum scan range of the preferred embodiment microwave scanner. Substantially all of the rest of the space between flat plates 32 and 34 is filled with polyethylene foam as is the circular waveguide 6.

Lens 36 has an impedance matching groove identical to the groove 52 (FIG. 2) cut into the edges of lens 18. The groove is cut in all edges of both lens 18 and 36 through which microwave energy passes to prevent reflection of energy. As with lens 18 the bottom of the groove in lens 36 follows the lens contour described below.

Figure 3:
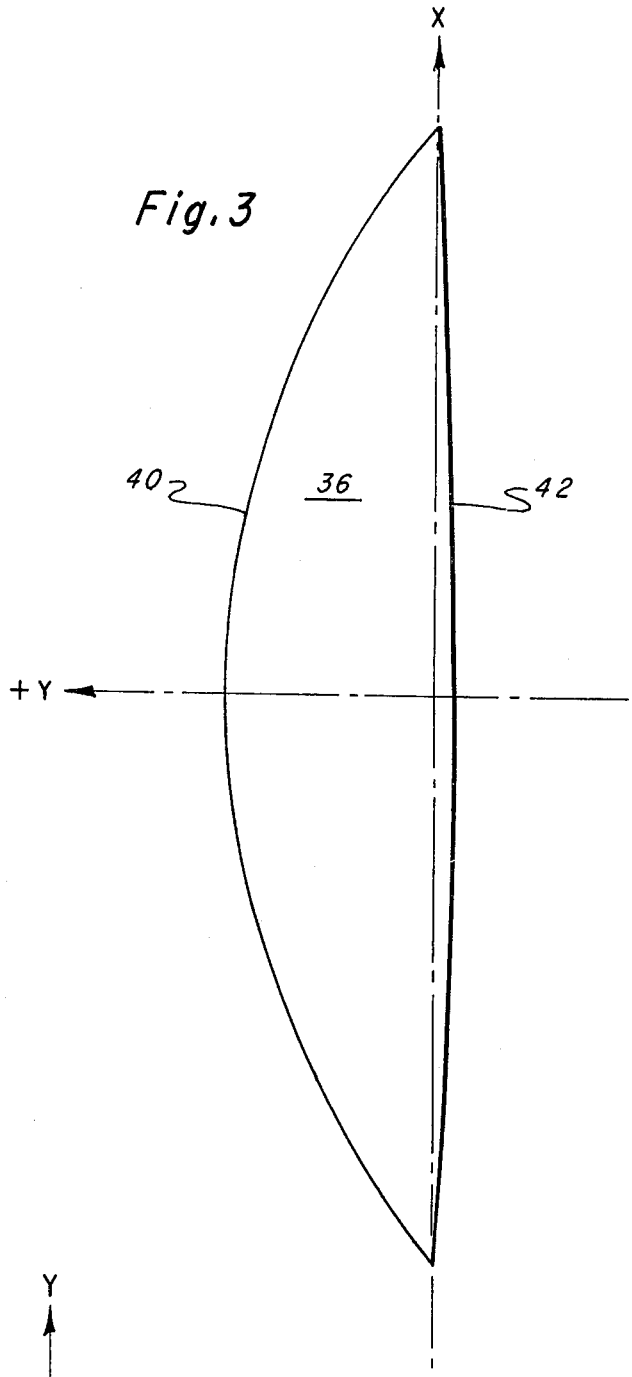
FIG. 3 illustrates the contour of the focal lens of FIG. 1.
Figure 4:
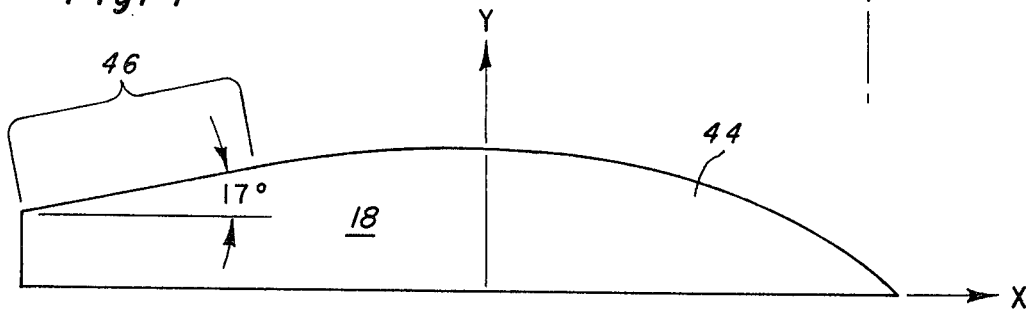
FIG. 4 illustrates the contour of the feed lens of FIGS. 1 and 2.

FIGS. 3 and 4 illustrate the contours of focal lens 36 and feed lens 18, respectively. The lenses are drawn with respect to an x-y coordinate system and the lens contours are described with respect to this system by equations of the form $y = A_0 + A_1x + A_2x^2 + A_3x^3 \ldots + A_nx^n$. For the contours 40 and 42 of focal lens 36 the constants $A_0$ through $A_7$ are set out in Tables 1 and 2, respectively

TABLE 1

| | |
|---|---|
| $A_0 = .714872\ (10)^1$ | $A_4 = -.260058\ (10)^{-4}$ |
| $A_1 = .232541\ (10)^{-2}$ | $A_5 = .153700\ (10)^{-5}$ |
| $A_2 = -.179026\ (10)^{-1}$ | $A_6 = -.521295\ (10)^{-7}$ |
| $A_3 = .206246\ (10)^{-3}$ | $A_7 = .699065\ (10)^{-9}$ |

TABLE 2

| | |
|---|---|
| $A_0 = -.743196$ | $A_4 = -.274969\ (10)^{-5}$ |
| $A_1 = -.154873\ (10)^{-3}$ | $A_5 = .164040\ (10)^{-6}$ |
| $A_2 = .232931\ (10)^{-2}$ | $A_6 = -.715545\ (10)^{-8}$ |
| $A_3 = .261425\ (10)^{-5}$ | $A_7 = .130249\ (10)^{-9}$ |

The curve 44 of feed lens 18 shown in FIG. 3 is described by the constants $A_0$ through $A_4$ set out in Table 3.

TABLE 3

| | |
|---|---|
| $A_0 = .376101\ (10)$ | $A_3 = -.215968\ (10)^{-2}$ |
| $A_1 = -.196793\ (10)^{-1}$ | $A_4 = .106441\ (10)^{-3}$ |
| $A_2 = -.195957\ (10)^{-1}$ | |

Feed lens 18 also has a straight portion 46 intersecting the curve 44. As illustrated in FIG. 4 the straight portion 46 is at an angle of 17° with respect to the $x$ axis.

Due to the straight portion 46 of feed lens 18, it may be described as an asymmetric lens. This shape was chosen for the preferred embodiment to reduce the angular distortion of the feed signal and thereby reduce the amount of input energy which travels directly from feed horn 20 to focal lens 36 without hitting reflector 16. The result is a higher energy beam at high elevation angles and less ground reflection signals, than could be achieved with a symmetrical lens.

While feed lens 18 is illustrated in FIG. 4 as a flat lens, it is bent to cylindrical shape when it is placed between the conductive plates 14 of cylindrical waveguide 6. In the preferred embodiment focal lens 36 remains flat as it is illustrated in FIG. 3. It is apparent that for other antenna sizes and lens shapes a portion of focal lens 36 may extend into cylindrical waveguide 6 and that portion is bent to conform to the cylindrical shape.

In operation, the scanner of FIGS. 1 and 2 functions in essentially the same way as the basic Lewis scanner. The feed horn 20 is rotated at a constant rate by the drive motor 24. In this preferred embodiment, microwave energy is supplied to input 26 only during the time when the feed horn 20 is within the 180° rotation which ends at the junction of cylindrical waveguide 6 and flat plate waveguide 28. With a vertical aperture 30, the scanned radiation pattern is a flat beam at 0° elevation, narrowly focused in the elevation angle and spread broadly in the azimuth angle. As the feed horn 20 rotates through its 180° active range, the radiated pattern increases in elevational angle to a maximum of 20° elevation. As with any Lewis type scanner the radiation pattern becomes conical as it is scanned away from the direction perpendicular to the aperture which is 0° elevation in this case.

In this preferred embodiment, focal lens 36 has best focus angles at + and −7½° transmission angles with respect to its central axis. Since the axis of lens 36 is raised 10° above the horizon, these best focus angles correspond to 2½° and 17½° elevation angles. The result is much better focusing over the entire 20° scan range than can be achieved by a single focus angle lens. The 2½° angle is chosen to provide near perfect focus at the normal airline approach path angle.

Although in the preferred embodiment the axis of lens 36 is positioned at half the maximum scan range other angles may also be used. Thus, if best focus was desired at scan angles of 0° and 12° elevation, a focal lens having best focus angles at + and −6° with respect to its central axis would be positioned with its axis at 6° elevation.

The feed lens 18 of FIG. 4 also helps to improve the elevational focus of the radiation pattern. The lens 18 provides a variable phase change in the energy path from the feed horn 20 to the focal lens 36 which causes the feed horn 20 to appear to be closer to the focal path of lens 36 than it physically is as the feed horn 20 rotates over its active range. This effect of a feed lens is disclosed in the above referenced U.S. Pat. No. 3,761,985 entitled "Wide Angle Microwave Scanning Antenna Array with Distortion Correction Means" issued to R. J. Silbiger et al on Sept. 25, 1973. The Silbiger patent disclosed that severe defocusing occurs at scanning angles above 20° without the use of feed lens. In the preferred embodiment of the present invention, the feed lens 18 provides substantially improved elevational focusing at angles within a 20° scan range. Additionally the asymmetric form of feed lens 18 improves the transmitted beam as described above.

Although the present invention has been shown and illustrated in terms of specific apparatus, it will be apparent that changes or modifications can be made without departing from the scope of the invention as defined by the appended claims.

What is claimed is:

1. A wide angle microwave scanning antenna comprising:

a waveguide assembly of two parallel conductive sheets spaced apart for providing a path for microwaves therebetween, said waveguide assembly having an input end for receiving microwave energy and a vertical output end for radiating said received energy in a pattern over a preselected range of elevation angles, a microwave focal lens positioned between said parallel conductive sheets with its axis inclined from the perpendicular to the radiating aperture.

feed means for coupling microwave energy from a source of microwave energy into said input end of said assembly including a movable feed element positioned substantially in the focal path of said focal lens throughout a preselected range of movement, the location of said feed element controlling the elevation angle of said radiated energy, and means coupled to said feed element for moving said element in said focal path.

2. A scanning antenna according to claim 1 wherein said focal lens has a plurality of best focus angles.

3. A scanning antenna according to claim 2 wherein said focal lens has two best focus angles.

4. A scanning antenna according to claim 3 wherein said antenna radiates over a 20° elevation range, the axis of said focal lens is inclined 10° above the perpendicular to the radiating aperture and the best focus angles of said focal lens are 7½° on either side of the lens axis.

5. A scanning antenna according to claim 1 wherein said feed means comprises:

a cylindrical waveguide intersecting said waveguide assembly at a line parallel to the cylindrical waveguide axis, and a helical microwave reflector positioned between the plates of said cylindrical waveguide, and wherein the microwave feed element is positioned at a circular edge of said cylindrical waveguide and is movable in a circular path following said circular edge for coupling microwave energy into said cylindrical waveguide in a substantially axial direction.

6. A scanning antenna according to claim 5 wherein said feed element is a microwave horn.

7. A scanning antenna according to claim 5 wherein said helical reflector is at an angle of 50° with respect to said cylindrical waveguide axis.

8. A scanning antenna according to claim 5 further including an asymmetric feed lens positioned between the conducting surfaces of said cylindrical waveguide at said circular edge.

* * * * *